US006928671B2

(12) United States Patent
Pagano et al.

(10) Patent No.: US 6,928,671 B2
(45) Date of Patent: Aug. 16, 2005

(54) TIE DOWN ASSEMBLY FOR POOL COVERS AND POOL COVER INCORPORATING SAME

(75) Inventors: Tony Pagano, Mayfield, NY (US); Craig Lewis, Ballston Lake, NY (US)

(73) Assignee: Latham Plastics, Inc., Scotia, NY (US)

( * ) Notice: Subject to any disclaimer, the term of this patent is extended or adjusted under 35 U.S.C. 154(b) by 195 days.

(21) Appl. No.: 10/635,323

(22) Filed: Aug. 6, 2003

(65) Prior Publication Data

US 2004/0025239 A1 Feb. 12, 2004

Related U.S. Application Data

(60) Provisional application No. 60/401,269, filed on Aug. 6, 2002.

(51) Int. Cl.[7] ..... E04H 4/10

(52) U.S. Cl. ..... 4/503; 160/378; 24/305

(58) Field of Search ..... 4/503; 24/305, 24/307; 267/71–74, 170, 179, DIG. 3; 160/329, 378; 182/139

(56) References Cited

U.S. PATENT DOCUMENTS 154,041 A * 8/1874 Hanna ..... 267/72
2,958,872 A * 11/1960 Meyer, Jr. ..... 4/503
5,259,078 A * 11/1993 Crandall ..... 4/503

* cited by examiner

*Primary Examiner*—Robert M. Fetsuga
(74) *Attorney, Agent, or Firm*—Steinberg & Raskin, P.C.

(57) ABSTRACT

A pool cover tie down assembly comprising a first strap which defines a loop, the first strap being secured to the pool cover at a location interiorly spaced from the edge of the pool cover, an anchor secured to the pool deck, a spring having a first end secured to the first strap and a second end secured to a second strap that extends from the spring and is coupled to the anchor, the second end of the spring being secured to the second strap at a location interiorly spaced from the edge of the pool cover such that the entire spring is location at a location interiorly spaced from said edge of the pool cover.

4 Claims, 2 Drawing Sheets

(Prior Art) FIG. 1

TIE DOWN ASSEMBLY FOR POOL COVERS AND POOL COVER INCORPORATING SAME

This application claims the benefit of provisional application No. 60/401,269, filed Aug. 8, 2002.

FIELD OF THE INVENTION

The present invention relates generally to a tie down assembly for securing a pool cover to a deck or the like and to a pool cover including a plurality of said tie down assemblies.

BACKGROUND OF THE INVENTION

Pool covers are presently available and are known to cover a swimming pool, as for reasons of safety and/or the unwanted entry into the pool of debris or the like; and, even to prevent heat loss. Typically, in this regard, a series of tie down assemblies, i.e. tensioning arrangements or fasteners, extending from the pool cover to an anchor embedded in the pool deck are employed to secure the cover to the surrounding deck surface. Each assembly may include a strap or web secured to the cover and engaging one end of a tension spring, where the opposite end of the latter is affixed to the aforesaid anchor.

Various tie down assemblies have been disclosed in the prior art. However such tie down assemblies generally require, at the very least, a three foot concrete deck surrounding the pool to effectively anchor the tensioning arrangements to the deck. Normally, in prior art arrangements, the cover extends twelve inches over the concrete deck, and strap extending from the cover extends approximately another nine inches and the spring attached to the strap to extends approximately another nine inches for a total of thirty inches. Further it is necessary to allow another six inches of pool deck from the anchor to the edge of the deck so that the anchor will not be so close to the edge that it will crack the concrete. Thus a total of three feet of clearance around the pool is generally required.

A typical prior art arrangement is shown in U.S. Pat. No. 4,916,763 to Christensen (hereinafter "the '763 patent"). The '763 patent appears to disclose a pool cover tie-down assembly including a web portion 12*a* having a first end secured to a peripheral edge of a pool cover and a second end which secured to a first end of a tension spring 14. The second end of the tension spring 14 is in turn secured to an anchor 15 embedded in the pool deck. As shown in the figures of the '763 patent the entire tie-down assembly extends past the outer peripheral edge of the pool cover.

OBJECTS AND SUMMARY OF THE INVENTION

It is therefore an object of the present invention to avoid the above drawbacks of prior art pool cover fastener (tie down) assemblies.

It is yet another object of the present invention to provide a new and improved pool cover tie down assembly which minimizes the required pool deck area surrounding pool cover required for securing the pool cover to the deck.

In view of the foregoing objectives a pool cover tie down assembly according to the present invention includes a first strap which defines a loop, the first strap being secured to the pool cover at a location interiorly spaced from the edge of the pool cover, an anchor secured to the pool deck, a spring having a first end secured to the first strap and a second end secured to a second strap that extends from the spring and is coupled to the anchor, the second end of the spring being secured to the second strap at a location interiorly spaced from the edge of the pool cover such that the entire spring is location at a location interiorly spaced from said edge of the pool cover.

BRIEF DESCRIPTION OF THE DRAWINGS

The following drawing is illustrative of the pool cover tie down assembly according to the present invention and is not meant to limit the scope of the invention.

DETAILED DESCRIPTION OF THE INVENTION

Figure 1:
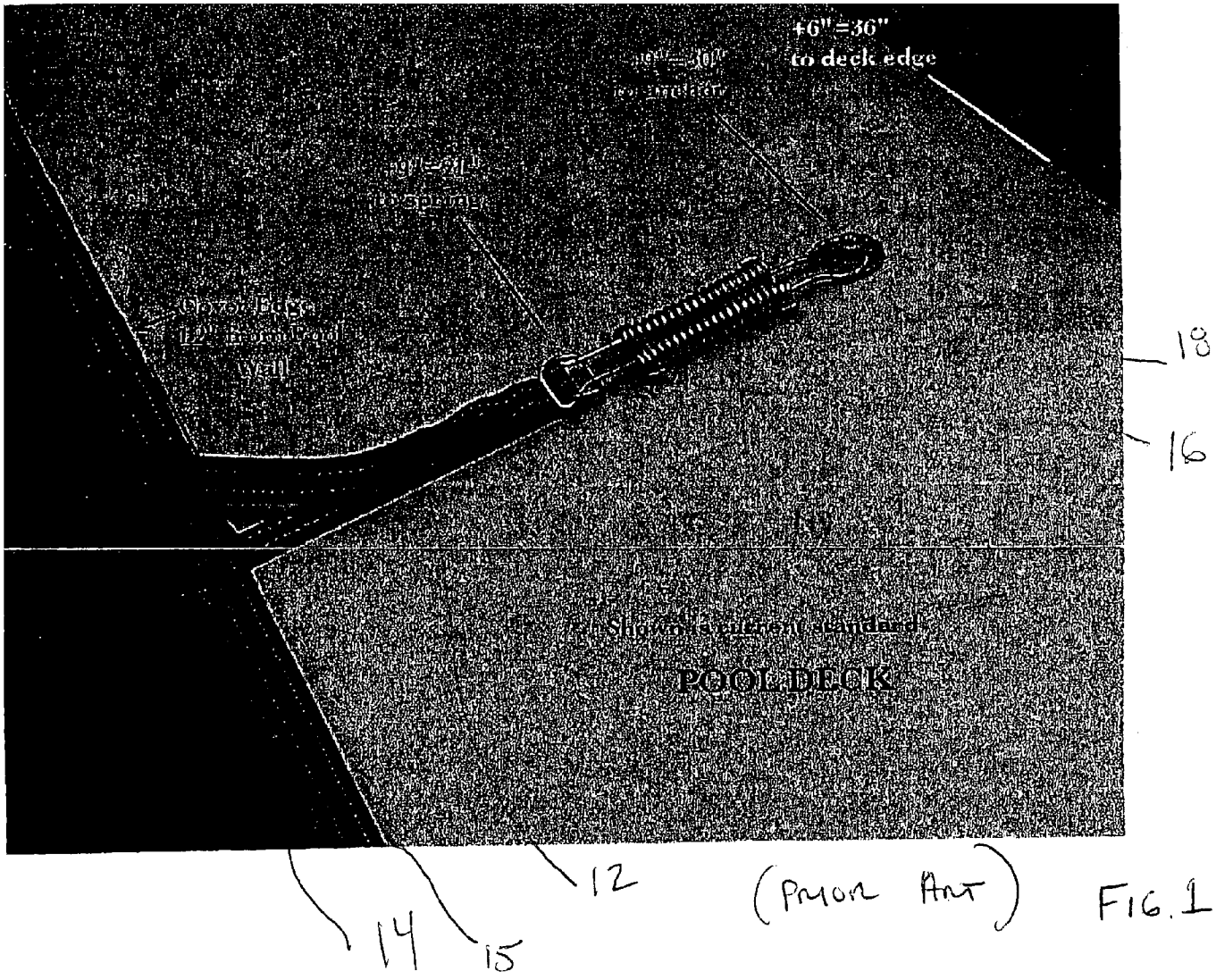
FIG. 1 is a schematic view of a prior art pool cover tie down assembly.

Referring to FIG. 1 a prior art pool cover tie down assembly 10 is shown. As shown the tie down assembly 10 includes a strap 12 which is coupled to, and extends outwardly from, a peripheral edge 15 of the pool cover 14. The strap 12 is coupled at its free end to a first end of a spring 16. The second end of the spring 16 is coupled to a anchor 18 which is secured to the pool deck PD.

As shown in FIG. 1, the entire structure of the prior art tie down assembly 10, including the strap 12 and spring 16 is located outside the peripheral edge 15 of the pool cover 14. This arrangement requires a significant amount of deck space to enable the tie down assembly to be installed. Typically outer peripheral edge 15 of the pool cover 14 extends 12" beyond the pool wall. The strap 12 usually extends another 9" inches beyond the peripheral edge 15 of the pool cover to the first end of the spring 16. The spring 16 then extends an additional 9 inches to the anchor 18. In order to insure that the anchor does not cause a crack in the pool deck an addition 6" inches of deck space is required between the anchor 18 and the edge of the deck. Thus a total of 36" is required to properly install prior art tie down assemblies.

Figure 2:
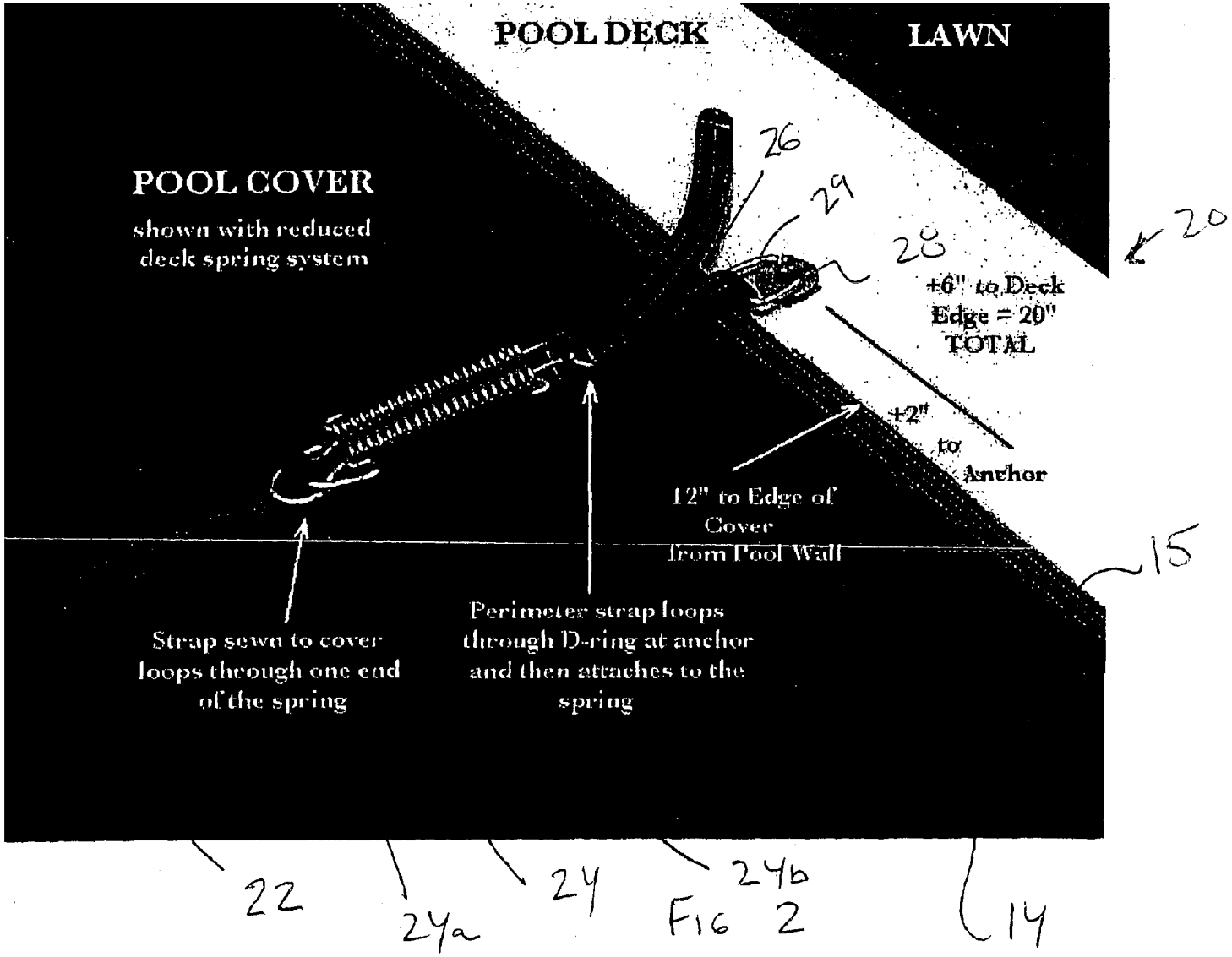
FIG. 2 is a schematic view of a pool cover tie down assembly according to the present invention.

The tie down assembly 20 according to the present invention will now be described with reference to FIG. 2. The pool cover tie down assembly 20 according to the present invention includes a first strap 22 which defines a loop, the first strap being secured to the pool cover at a location interiorly spaced form the edge of the pool cover. The assembly 20 further includes a spring 24 having a first end 24*a* secured to the first strap 12 and a second end 24*b* secured to a second strap 26 that extends from the spring 24 and is coupled to an anchor 28. Specifically the second strap 26 loops through a D-ring 29 which is coupled to the anchor 28. It is noted that the second end 24*b* of the spring 24 is secured to the second strap 26 at a location interiorly spaced from the edge 15 of the pool cover 14 such that the entire spring 24 is located at a location interiorly spaced from said edge 15 of the pool cover 14.

The above described arrangement of the pool cover tie down assembly according to the present invention enables the securement of a pool cover to a deck with significantly less deck space required between the peripheral edge of the cover and the edge of the deck. Specifically the edge of the pool cover 14 extends beyond the pool wall approximately 12". The anchor 28 is arranged approximately 2" beyond the peripheral edge 15 of the pool cover 14 and approximately 6" from the edge of the pool deck. Thus a total of only approximately 20" is required for the installation of the pool cover tie down assembly according to the present invention.

It is understood that a plurality of the above described pool cover tie down assemblies would be utilized when securing a pool cover to a deck, the tie down assemblies being located at spaced locations about the periphery of the pool cover. It is noted that a pool cover employing a plurality of said pool cover tie down assemblies as described is within the scope of the present invention.

Although an exemplary embodiment of the present invention has been shown and described, it will be apparent to those having ordinary skill in the art that a number of changes, modifications or alterations may be made, none of which depart from the spirit of the present invention. All such changes, modifications or alterations should therefore be seen as within the scope of the present invention.

We claim:

1. A pool cover tie down assembly comprising a first strap which defines a loop, the first strap being secured to the pool cover at a location interiorly spaced from the edge of the pool cover, an anchor secured to the pool deck, a spring having a first end secured to the first strap and a second end secured to a second strap that extends from the spring and is coupled to the anchor, the second end of the spring being secured to the second strap at a location interiorly spaced from the edge of the pool cover such that the entire spring is location at a location interiorly spaced from said edge of the pool cover.

2. A pool cover tie down assembly as claimed in claim 1, wherein the second strap loops through a D-ring which is coupled to the anchor.

3. A pool cover tie down assembly as claimed in claim 1, wherein the second end of the spring is secured to the second strap at a location interiorly spaced from the edge of the pool cover such that the entire spring is located at a location interiorly spaced from said edge of the pool cover.

4. A pool cover tie down assembly system comprising a plurality of pool cover tie down assemblies, wherein each of said pool cover tie down assemblies comprises a first strap which defines a loop, the first strap being secured to the pool cover at a location interiorly spaced from the edge of the pool cover, an anchor secured to the pool deck, a spring having a first end secured to the first strap and a second end secured to a second strap that extends from the spring and is coupled to the anchor, the second end of the spring being secured to the second strap at a location interiorly spaced from the edge of the pool cover such that the entire spring is location at a location interiorly spaced from said edge of the pool cover.

* * * * *